US006347474B1

(12) United States Patent
Wolff, Jr.

(10) Patent No.: US 6,347,474 B1
(45) Date of Patent: Feb. 19, 2002

(54) TRIGGER RETURN SYSTEM FOR A FIREARM

(76) Inventor: Walter C. Wolff, Jr., 2009 Fox Creek Rd., Berwyn, PA (US) 19312

( * ) Notice: Subject to any disclaimer, the term of this patent is extended or adjusted under 35 U.S.C. 154(b) by 0 days.

(21) Appl. No.: 09/553,550

(22) Filed: Apr. 20, 2000

Related U.S. Application Data

(60) Provisional application No. 60/130,727, filed on Apr. 22, 1999.

(51) Int. Cl.[7] ..... F41A 19/00
(52) U.S. Cl. ..... 42/69.01; 42/69.03
(58) Field of Search ..... 42/69.01, 65, 69.03, 42/41, 69.02

(56) References Cited

U.S. PATENT DOCUMENTS

| | | | | | |
|---|---|---|---|---|---|
| 1,002,798 | A | * | 9/1911 | Baker | 42/69.01 |
| 3,654,720 | A | | 4/1972 | Ruger | |
| 3,903,630 | A | | 9/1975 | Dirstine | |
| 3,983,654 | A | * | 10/1976 | Vironda | 42/69.01 |
| 4,067,131 | A | | 1/1978 | Ruger et al. | |
| 4,123,963 | A | * | 11/1978 | Junker | 89/152 |
| 4,213,263 | A | | 7/1980 | Brouthers | |
| 4,344,351 | A | | 8/1982 | McQueen | |
| 4,391,057 | A | * | 7/1983 | Bornancini | 42/65 |
| 4,400,900 | A | | 8/1983 | Hillberg et al. | |
| 4,766,687 | A | * | 8/1988 | Ruger | 42/65 |
| 4,819,358 | A | * | 4/1989 | Eder | 42/65 |
| 4,908,970 | A | | 3/1990 | Bell | |
| 4,962,605 | A | | 10/1990 | Aigner | |
| 5,487,233 | A | | 1/1996 | Jewell | |
| 5,548,914 | A | | 8/1996 | Anderson | |
| 5,709,046 | A | * | 1/1998 | Canaday | 42/69.01 |
| 5,924,231 | A | | 7/1999 | Kidd | |

* cited by examiner

*Primary Examiner*—Peter M. Poon
*Assistant Examiner*—Susan Piascik
(74) *Attorney, Agent, or Firm*—Ratner & Prestia; Jonathan H. Spadt

(57) ABSTRACT

The present invention provides an improved trigger return spring system via an interchangeable, replacement gun trigger return system mechanism for use in firearms, particularly a Beretta® Model 92/96 series firearm and similar firearms. The interchangeable, replacement gun trigger return system comprises a trigger return pin having a first end and a second end, a trigger return cam having a first cavity adapted to receive a trigger bar and a second cavity adapted to receive the second end of the return pin, and a spring. The invention includes methods of replacing the existing, factory installed spring, as well as using the present invention in originally manufactured firearms.

21 Claims, 9 Drawing Sheets

TRIGGER RETURN SYSTEM FOR A FIREARM

This application claims the benefit of earlier-filed U.S. Provisional Application Ser. No. 60/130,727 filed on Apr. 22, 1999, the content of which is incorporated by reference herein.

FIELD OF THE INVENTION

This invention relates generally to firearms, and more specifically to a trigger return system for firearms.

BACKGROUND OF THE INVENTION

There are many different types of firearm actions. The action defines how the gun is constructed and how it functions. The action defines, at least in part, how the trigger is pulled, what happens mechanically to cause the firing pin to strike the cartridge's primer, how the empty casing is removed from the firing chamber, and how the next cartridge is placed into the firing chamber for the next shot.

For example, a handgun is generally either a revolver or a semiautomatic. There are, of course, other types of actions, but most handguns on the market today are either revolvers or semiautomatic. The revolver predated the semiautomatic in the development of handguns. At the very least, all typical revolvers have a frame, a hammer, a trigger, a cylinder, a barrel, and a firing pin. The cylinder holds several cartridges, each in its respective chamber. As the cylinder rotates during operation of the gun, each chamber takes its turn in line with the barrel. As the firing pin is actuated through the user's pulling of the trigger, the drop of the hammer causes the firing pin to strike the cartridge's primer, igniting the powder in the cartridge's casing, thus expelling the projectile, first through the barrel and ultimately toward the target.

After a shot is fired from the revolver, the cylinder must rotate to bring the next chamber which contains a cartridge in line with the barrel. Generally, this process is repeated until all bullets have been fired, at which point the empty casings can be removed and replaced with live rounds.

There are two well-known revolver actions, each of which applied to revolvers during their development. These are known as "single action" and "double action." The single action revolver was the first general type of revolver developed. This firearm required that the hammer be manually pulled, or cocked, each time the gun was to be fired. By cocking the hammer, the user of the pistol caused the cylinder to rotate and thereby bring the next chamber in line with the barrel. When the trigger was pulled, the hammer fell, causing the firing pin to strike the ignition system and fire the gun. For the next shot to be fired, the hammer was again cocked, usually with the user's thumb, which rotated the cylinder, and the gun could be fired again.

The second type of action was developed later. This action became known as the "double action" revolver. In this case, the hammer did not have to be cocked by hand prior to pulling the trigger. The user of a double action revolver could simply pull the trigger and the gun would fire. The pulling of the trigger caused two actions to occur. The first part of the trigger pull caused the hammer to cock itself, while simultaneously the cylinder rotated, bringing the next chamber in line with the barrel. The second part of the same trigger pull resulted in the hammer falling and the striking of the ignition system. Thus, the term "double action" was adopted to describe the "double action" achieved by pulling the trigger. The hammer was cocked and dropped, sequentially, with a single pull of the trigger.

The double action revolver could, however, be cocked by hand, just as a single action revolver must be cocked by hand. In such a case, a slight pull of the trigger on the double action revolver would then fire the gun as in the case of the single action.

Conventional semiautomatic handguns were developed as early as the beginning of the 1900's. Semiautomatic handguns can, generally, be distinguished from a revolver in that the expended cartridge casing is expelled from the gun and the next cartridge is brought into the firing chamber "automatically" upon firing the gun. Various mechanisms for accomplishing this objective, including gas pressure, recoil operated, and blow-back designs, have been developed.

Generally, the semiautomatic firearm action provides a mechanism for ejecting a spent casing from the gun completely, immediately after that round is fired. As a part of the mechanics for ejecting the spent shell, the next cartridge is fed into the firing chamber and the gun is ready to be fired again. Typically, the first shot fired from the semiautomatic does not require that the gun's hammer be manually cocked as in the case of a single action revolver. The user may cock the hammer manually, and then pull the trigger, or may pull the trigger which will, as in the case of the double action revolver, cock the hammer and then allow the hammer to fall, all in one pull of the trigger. Thus, borrowing terminology from its predecessors, the semiautomatic firearm which could be fired for the first time simply with a pull of the trigger (without cocking the hammer manually) was dubbed a "double action semiautomatic." The focus of the terminology was the first shot fired from the gun in a series of shots. Thus, when the hammer is down, it may either be cocked manually, or not, depending on the choice of the user.

Usually, after the first shot is fired, that casing is expelled, the next round is brought into the firing chamber, and the hammer is cocked for the next shot, all in one cycle. Thus, the hammer is automatically cocked after each shot of the double action semiautomatic firearm, ready to be dropped again by the next pull of the trigger. For most of the development of the semiautomatic firearm, until recently, there was no semiautomatic firearm in which the hammer always stayed uncocked after each and every shot.

Recently, the "double action only" semiautomatic firearm ("DA only") was developed. This mechanism is different from earlier semiautomatic firearms in that each time the "DA only" is fired, the mechanism cycles but the hammer comes to rest in the uncocked position. There is no way to cock the "DA only" first, as was the case in single action revolvers, double action revolvers, and double action semiautomatics. A bit of a confusing term, the "DA only" mechanism simply means that the gun cannot first be manually cocked by the user, prior to pulling the trigger. Many "DA onlys" do not even have an exposed hammer. In such a case, the hammer is inside the frame of the gun.

The "DA only" was developed largely for law enforcement and self-defense purposes. Because a gun whose hammer remains cocked requires, in almost all cases, relatively light pressure on the trigger to be fired (as opposed to when it is uncocked and the trigger pull serves first to cock the gun), it was thought by some that in a high-stress situation, the likelihood of an accidental firing was increased where a semiautomatic's hammer was automatically cocked after each shot. Where, on the other hand, the trigger needs to be pulled through its entire range each and every time the gun is to be fired, some thought the likelihood of an accidental discharge was diminished.

With the development of the "DA only", and its subsequent adoption by many governmental agencies, many training standards were developed for its use by the agents. One problem with the "DA only" is that the user must exert a relatively large amount of force on the trigger each time a shot is needed. Thus, when the user wishes to fire rapidly over a length of time, the user's hand and finger often get fatigued.

This was especially true in the case of many Beretta® (Beretta is a registered trademark of Beretta U.S.A. Corp.) pistols. One factor in trigger finger fatigue can be attributed to the spring which returns the trigger to its forward position after the shot is fired. The more rigid the spring, the more strength is required to pull the trigger through its cycle.

Another problem with some conventional "DA only" trigger return springs is that they can prematurely fail, particularly where torsion springs are utilized, rendering the gun effectively useless. This is, of course, especially problematic and dangerous in the case of law enforcement and self-defense.

Thus, an improved trigger return system would provide a greatly improved lifetime and enhanced performance.

SUMMARY OF THE INVENTION

The present invention provides an improved trigger return spring system via an interchangeable, replacement gun trigger return system mechanism for use in firearms, particularly the Beretta® Model 92/96 series firearms and mechanically similar firearms. The interchangeable, replacement gun trigger return system comprises a trigger return pin having a first end and a second end, a trigger return cam having a first cavity adapted to receive a trigger bar pin and a second cavity adapted to receive the second end of the return pin, and a coil spring. The invention also includes both a method of replacing the existing, factory-installed spring without making any modifications to the existing firearm, and a method of installing the present invention during original firearm manufacture.

BRIEF DESCRIPTION OF THE DRAWING

The features of the invention believed to be novel and the elements characteristic of the invention are set forth herein. The figures are for illustration purposes only and are not necessarily drawn to scale. The invention itself, however, both as to organization and method of operation, may best be understood by reference to the detailed description which follows, taken in conjunction with the accompanying drawing in which.

DETAILED DESCRIPTION OF THE INVENTION

The present invention provides an improved trigger return spring system via an interchangeable, replacement gun trigger return system mechanism for use in firearms, particularly a Beretta® Model 92/96 series firearm and similar firearms. Similar firearms would include such firearms as, for example, the M-9, which is the designation for the military variation of the Beretta® Model 92/96 series, as well as the Model PT-92 and Model PT-99, manufactured by Taurus International Manufacturing, Inc.

The interchangeable, replacement gun trigger return system 10 comprises a trigger return pin having a first end 130*a* and a second end 130*b*, a trigger return cam 100 having a first cavity adapted to receive a trigger bar and a second cavity adapted to receive second end 130*b* of the return pin, and a spring. The apparatus is illustrated in FIGS. 1A and 1B.

The interchangeable, replacement gun trigger return system 10 of the present invention is particularly useful for several reasons. First, it is easily inserted in place of the spring supplied with the gun from the factory, without making any modifications to the factory gun. Minimal work needs to be done in order to replace the factory spring. Second, replacement gun trigger return system 10 is more durable and provides longer life and more reliable performance than many of the factory torsion springs. Third, trigger finger fatigue can be reduced through the utilization of springs with smaller spring constants (less rigid springs). Of course, where the spring is selected to be less rigid, it must be kept in mind that it must be rigid enough to effectively return the trigger to its forward position.

Figure 1A:
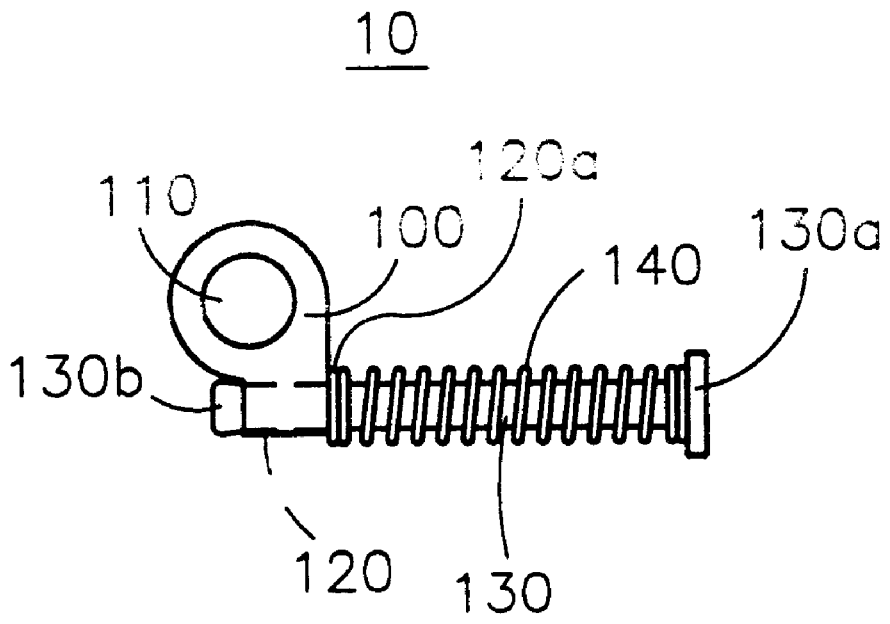
FIGS. 1A and 1B illustrate the gun trigger return system according to the present invention.
Figure 1B:
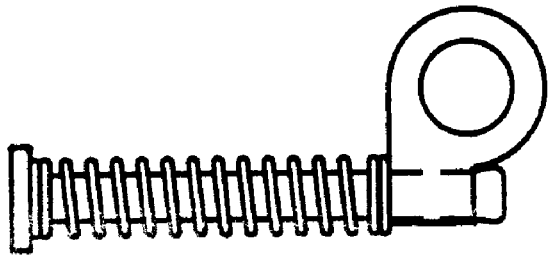

FIGS. 1A and 1B show the gun trigger return system 10 according to the present invention. A trigger return cam 100 is provided with two cylindrical holes having transverse radii. Hole 110 is provided to receive the trigger bar and hole 120 is provided to receive trigger return pin 130. Compression spring 140 is helically wound and in compression around trigger return pin 130. Spring 140 is held in place by an enlarged diameter end 130*a* of pin 130 at one end of spring 140 and by one end wall 120*a* of hole 120 at the other end of spring 140.

Figure 2:
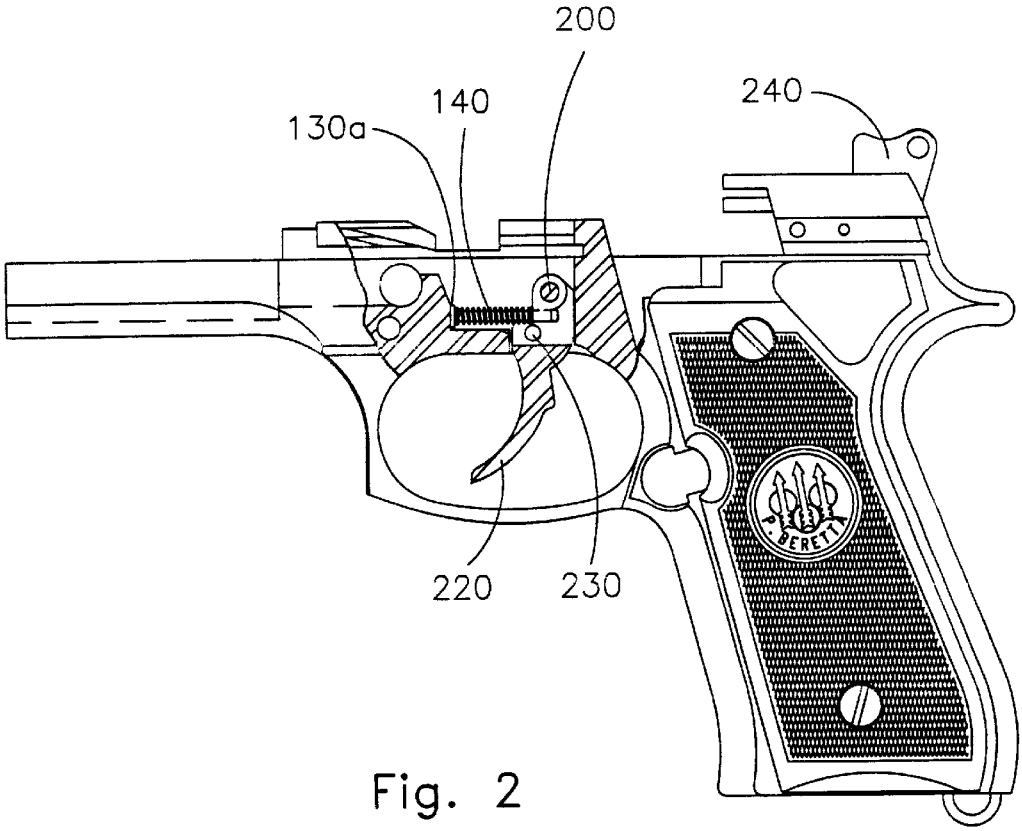
FIG. 2 illustrates a partial cutaway view of a semiautomatic firearm with the interchangeable, replacement gun trigger return system in place with the trigger in its forward (at rest) position.

FIG. 2 shows the system in place in a firearm. Trigger bar pin 200 is received in hole 110 when the system 10 is in place. The first end 130*a* of trigger return pin 130 abuts a generally vertical wall in the trigger assembly cavity of the gun frame and thus the system is held in place by trigger bar pin 200 (which is disposed through trigger return cam 100) and the first end 130*a* of the trigger return pin 130.

Figure 3:
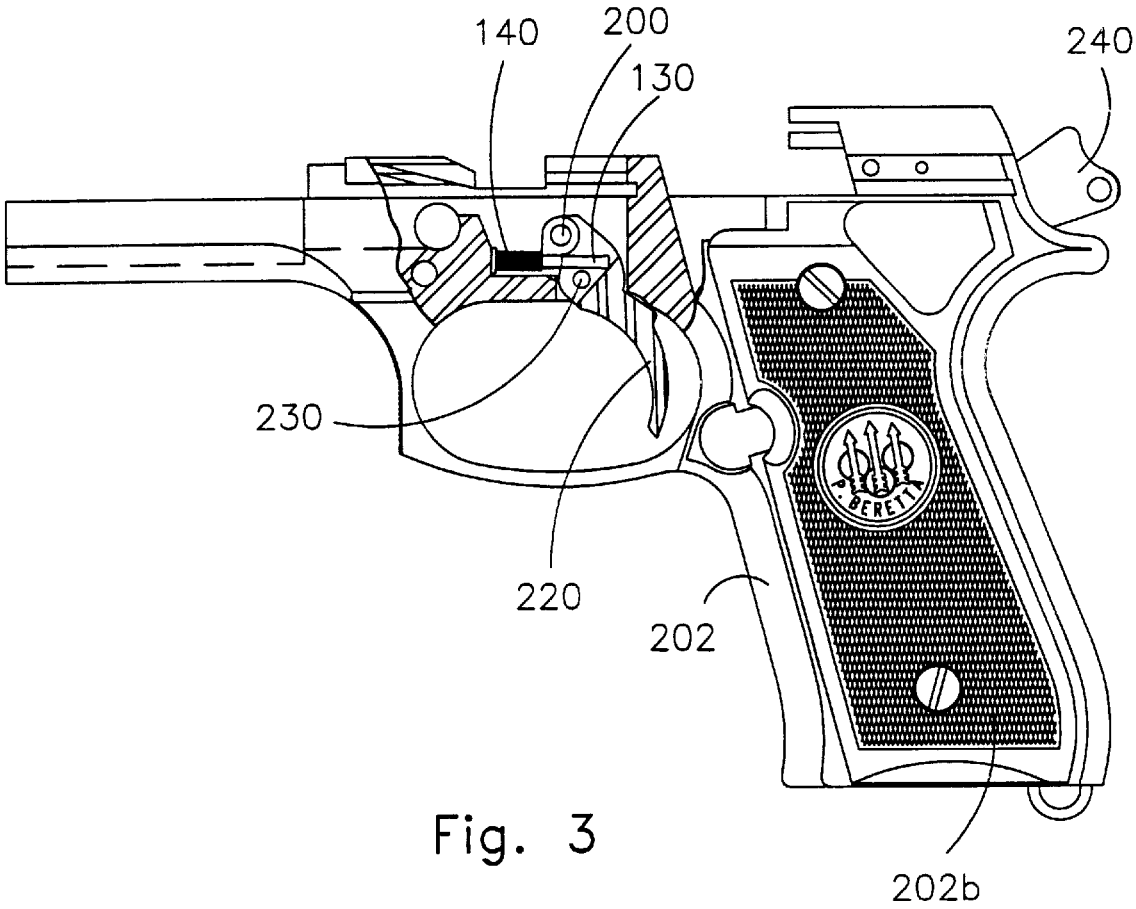
FIG. 3 illustrates a partial cutaway view of a semiautomatic firearm with the interchangeable, replacement gun trigger return system in place with the trigger in its rearward ("ready to fire" or "firing") position.

FIGS. 2 and 3 show the replacement gun trigger return system 10 in accordance with the present invention in place with the trigger 220 in its forward position and rearward position, respectively. As the trigger 220 is pulled from its forward (at rest) position to its rearward "let-off" position (the "let-off" position is that position where the gun is about to fire), spring 140 is further compressed from its rest state. The trigger 220 pivots around trigger pivot pin 230. FIGS. 2 and 3 also show the respective position of hammer 240 as trigger 220 is pulled. When the trigger 220 is forward (FIG. 2), the hammer 240 is at rest. As the trigger 220 is pulled and pivots around trigger pivot pin 230, hammer 240 is cocked (FIG. 3) until trigger 220 is pulled far enough to release the hammer 240, at which time the hammer falls causing the firing pin (not shown) to jolt forward (which would fire the gun if it is loaded).

The trigger return cam 100 slides along trigger return pin 130 as the trigger 220 is pulled. This can be seen more clearly through an examination of FIG. 3 which shows spring 140 in its further compressed position and trigger return pin 130 extending further out of hole 120 than is the case when the trigger 220 is in its forward position.

Figure 4:
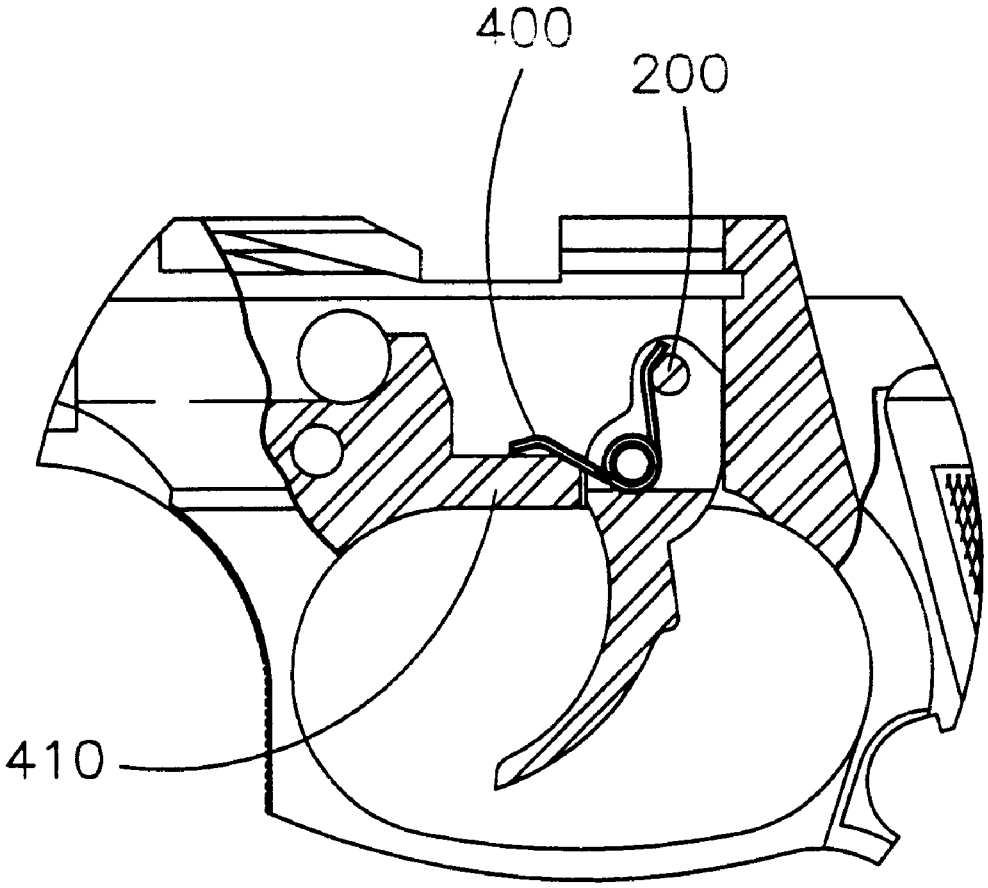
Fig. 4 Prior Art
FIG. 4 illustrates a partial cutaway view of a semiautomatic firearm with the trigger spring according to the prior art.

FIG. 4 shows a conventional trigger torsion spring 400 which is common in many semiautomatics, particularly the Beretta® Model 92/96 series firearm and related firearms. Trigger bar pin 200 is one point of restraint on torsion spring 400, and the other end of torsion spring 400 is an internal surface of part of the frame 410. Torsion spring 400 is prone to premature breakage after as little as several thousand rounds have been fired.

Figure 5:
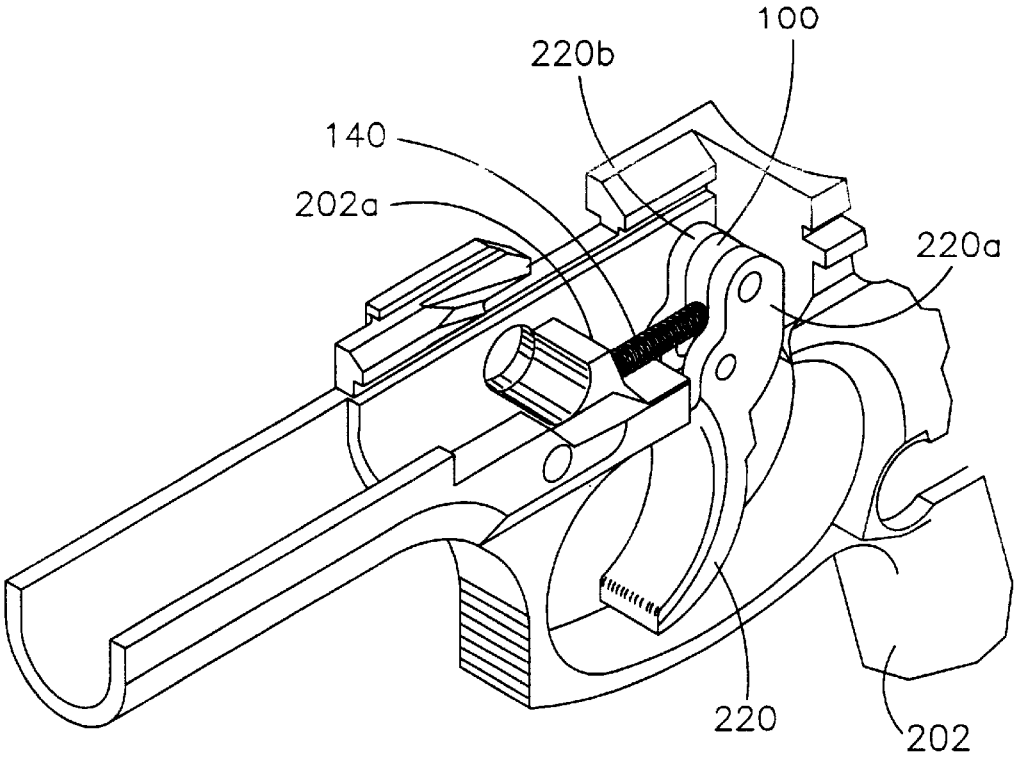
FIG. 5 illustrates a partial overhead view of the interchangeable, replacement gun trigger return system of the present invention.
Figure 5A:
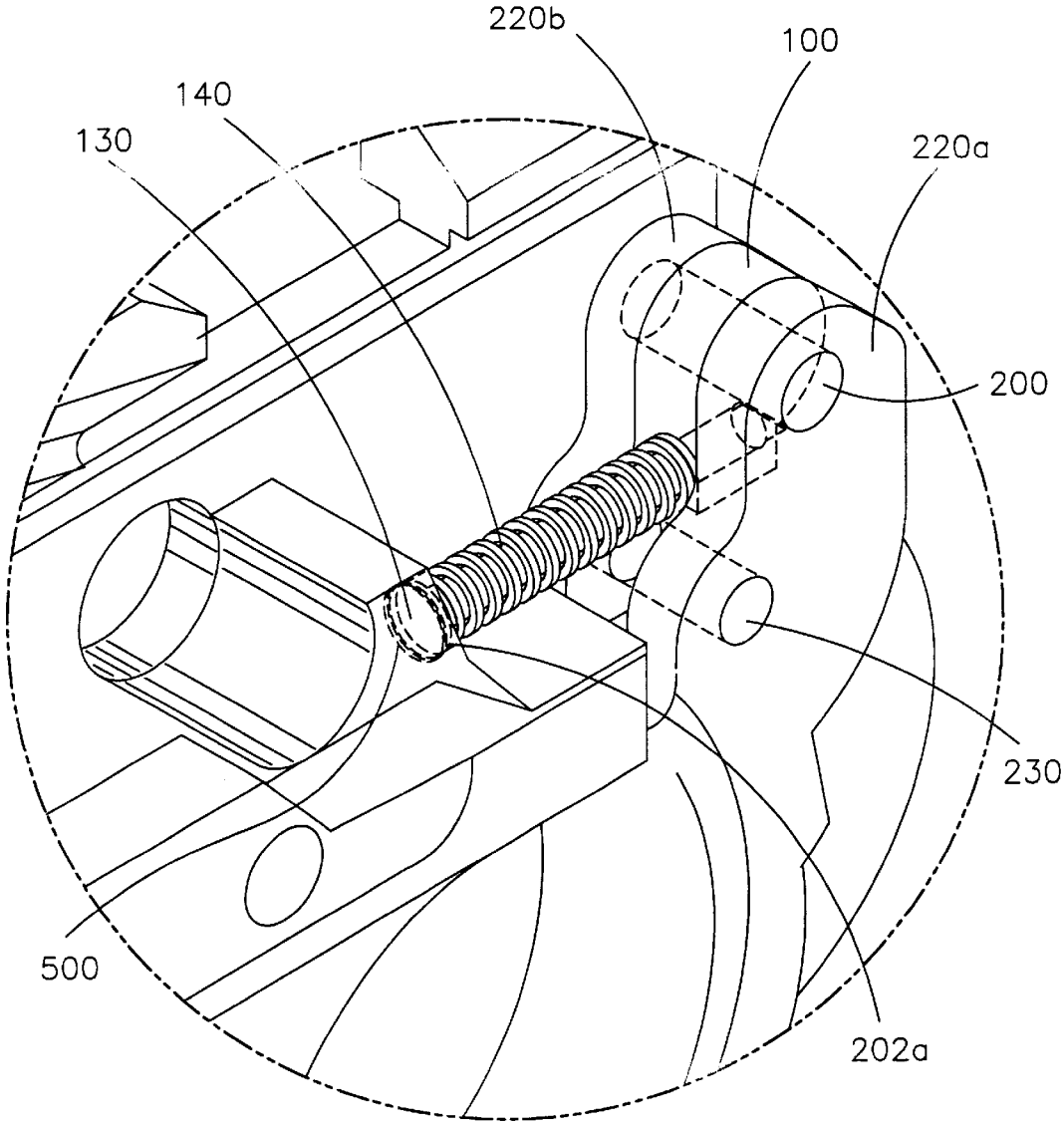
FIG. 5A illustrates a second partial overhead view of the interchangeable, replacement gun trigger return system of the present invention.
Figure 6:
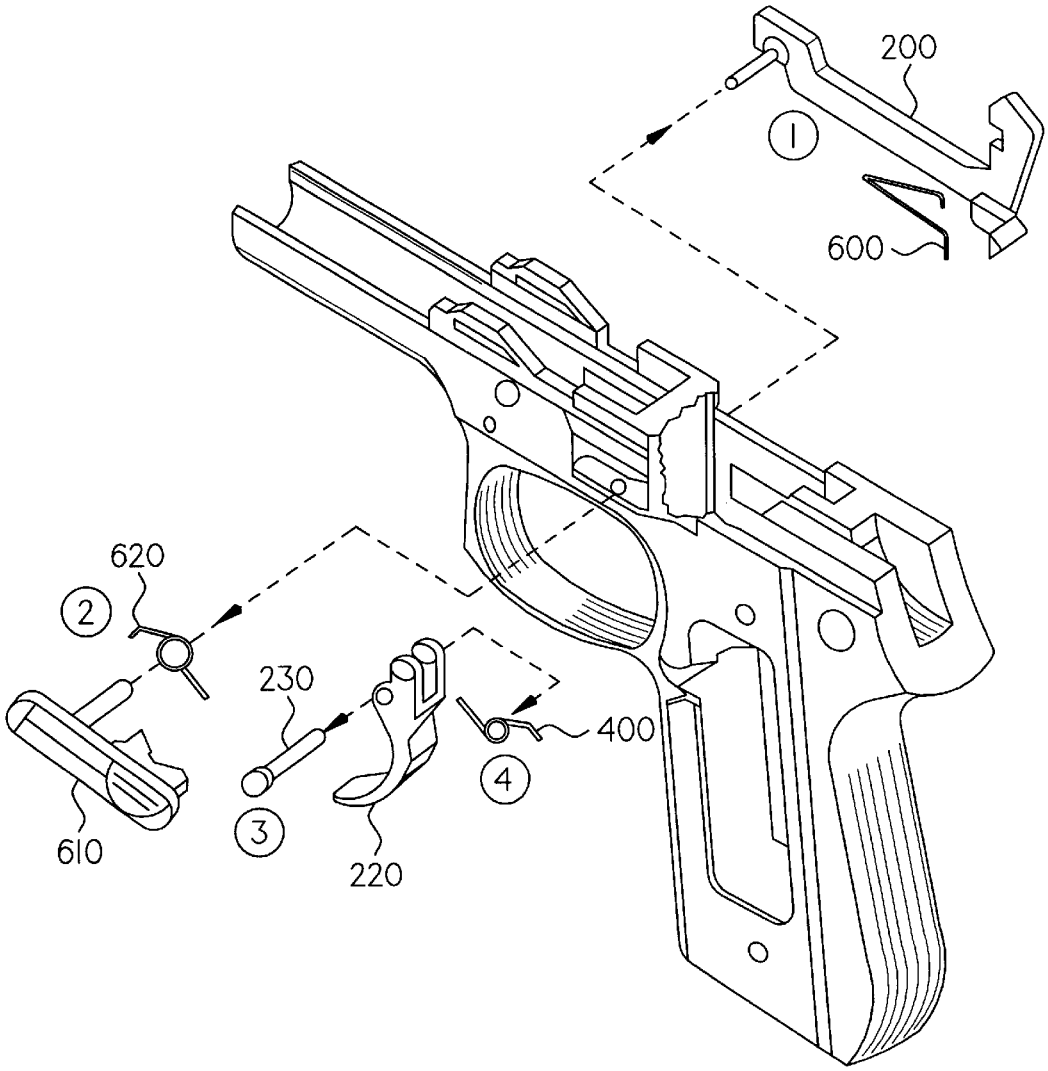
FIG. 6 illustrates some of the steps taken to replace a prior art trigger spring with the interchangeable, replacement gun trigger return system of the present invention.

FIG. 5 shows a partial overhead view of the interchangeable, replacement gun trigger return system 10 of the present invention. As best shown in FIGS. 5, 5A, and 6, conventional trigger 220 has a forked shaped upper portion defined by parallel upwardly extending identical upper walls 220*a* and 220*b*. Trigger return cam 100 is slidingly disposed between walls 220*a* and 220*b*. In other words, between upper walls 220*a* and 220*b* of the trigger lies the trigger return cam 100, which cam is adapted to rotate around trigger bar pin 200. FIG. 5 also shows that the front surface of end 130*a* of trigger return pin 130 presses against an upwardly extending wall 202*a* of gun frame 202. The front surface of end 130*a* of trigger return pin 130 securely engages wall 202*a*.

In another embodiment, an indent of wall 202*a* may be formed so as to receive return pin 130. Although not necessary, such an adaptation aids in maintaining the front surface of end 130*a* of trigger return pin 130 in place. This adaptation could take several forms, including a groove, notch, recess, or any concave space which would be sized to receive the front surface of end 130*a* of trigger return pin 130. Such a recess, although not required, could be added to an after-market gun, but would likely be part of the frame that is originally manufactured by the original equipment manufacturer (OEM). An example of such a recess is shown as recess 500 in FIG. 5A.

An additional embodiment includes the addition of a small pin or rod extending outward from the surface of end 130*a* of trigger return pin 130 which would enter an appropriate recess in the frame wall 202*a*. This configuration would also operate to hold the overall mechanism in place within the firearm, and would primarily be utilized by an OEM.

Figure 5B:
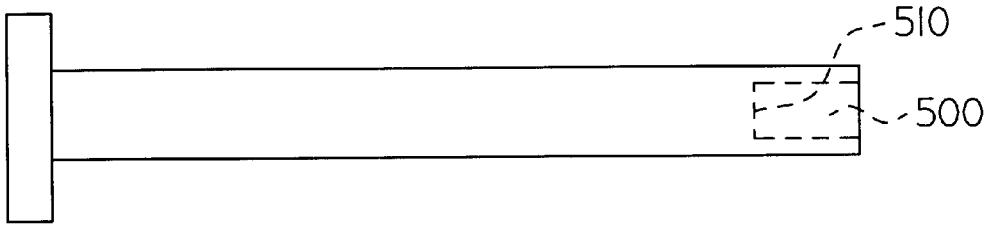
FIG. 5B illustrates one example of a cavity in the pin of the present invention.
Figure 5C:
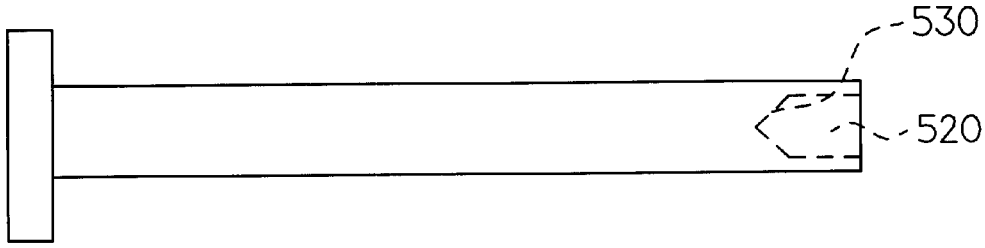
FIG. 5C illustrates an alternative cavity in the pin of the present invention.
Figure 5D:
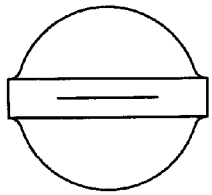
FIG. 5D illustrates a crimped end of the pin according to the present invention.

In a preferred embodiment, after the unit is assembled and end 130*b* of the trigger return pin 130 is inserted through hole 120 in the cam 100, end 130*b* of trigger return pin 130 is deformed slightly to secure the unit together. Of course, once unit 10 is installed into a firearm, this would not be important, but particularly where the unit is used as a replacement unit (instead of being originally installed at the factory), it would easily fall apart prior to being placed into the gun without such a deformation because the cam and spring would fall off the pin. Several methods may be used to increase the cross sectional area of the second end of the trigger return cam so as to prevent it from slipping back through cam 100. For example, end 130*b* of return pin 130 may be bent or crimped. Preferably, the end 130*b* is first drilled coaxially in such a way as to form a cavity within the pin. The wall surrounding the cavity can then be either crimped or flared outward to increase the diameter of end 130*b*. Of course, a crimp can be formed without first forming a cavity, but a crimp is more easily formed where the pin has been first drilled. Examples of a pin with a cavity as described are shown in FIGS. 5B and 5C. In FIG. 5B, cavity 500 is flat at its inner most surface 510. FIG. 5C shows an alternatively shaped cavity 520 where the inner most surface 530 is cone-shaped. Moreover, the forming (usually by drilling) of any such cavity allows a flat crimp to be made in the end of the pin 130, as shown in FIG. 5D.

The crimp or deformation (such as flaring) can take any number of forms, so long as it is not so large that it interferes with movement of the trigger. More specifically, it should not interfere with movement between upper walls 220*a* and 220*b* of trigger 220 and trigger bar pin 200, or with rotation around trigger pivot pin 230. This is another reason why first making a cavity in the end of the pin is beneficial. In those cases where the cavity is made prior to crimping the end 130*b* of pin 130, the crimp is generally flat, as shown in FIG. 5D. This is particularly desirable in those cases where there is limited space between the end 130*b* of return pin 130 and the part of the trigger between the base of upper walls 220*a* and 220*b* when the trigger is in its let-off position, as shown in FIG. 3. The flat crimp is allowed to position itself (i.e. horizontally) in such a way as to avoid contact with the part of the trigger between the base of upper walls 220*a* and 220*b* when the trigger is in its let-off position. This positioning may not occur where a flared end or other such deformation is used. Moreover, where limited space is a problem, the pin size and crimp need to be of a size appropriate to allow full range of unobstructed motion of the trigger and its surrounding components.

The trigger return pin 130 and trigger return cam 100 can be constructed of any suitable material, such materials including carbon steel and stainless steel. Trigger return pin 130 must be of sufficient hardness while still allowing it to be crimped. A preferred material for the return pin is stainless steel, particularly a 416T stainless steel. A suitable material for the trigger return pin would have a Rockwell hardness of about 25–35. The trigger return cam 100 should be a bit harder, a preferred range being about 42–45 on the Rockwell scale. It is also possible to treat the trigger return pin with some type of lubricant (i.e. oil) or material which will aid in pin 130 moving through the spring and the cam. Electroless nickel with a teflon PTFE (polytetrafluoroethylene) finish is one suitable material.

Spring 130 can be selected to meet the needs of the user such that a lighter or heavier trigger pull can be achieved. In the case where the trigger pull is made lighter, it is important to insure that the gun still functions reliably; if the spring has an insufficient spring constant, the gun may not work effectively or at all. A typical material for the spring is carbon steel, a preferred spring being made of an ASTM A-228 carbon steel.

One advantage to the present invention, as discussed briefly above, is the ease with which the factory torsion spring can be replaced with the present invention. The interchangeable, replacement gun trigger return system can be swapped with the factory spring in a matter of minutes, without any modification to the gun, and will provide the gun owner with a more reliable weapon.

To replace factory spring 400 (FIG. 4) with the spring system of the invention, only several steps need to be followed. In a typical case, such as for a Beretta® Model 92/96 series firearm, the slide and barrel (not shown) are removed in their normal manner, and grip covers 202*b* (FIG. 3) are removed by unscrewing the grip screws. Next, the trigger bar spring 600 and trigger bar pin 200 are removed as shown in FIG. 6 as step 1. Then, the slide lock 610 and slide lock spring 620 are removed as shown in FIG. 6 as step 2. After that, the trigger pivot pin 230 is removed as shown in FIG. 6 as step 3. After the trigger pivot pin 230 has been removed, the trigger 220 and the factory trigger return spring 400 are removed as shown in FIG. 6 as step 4.

Figure 7:
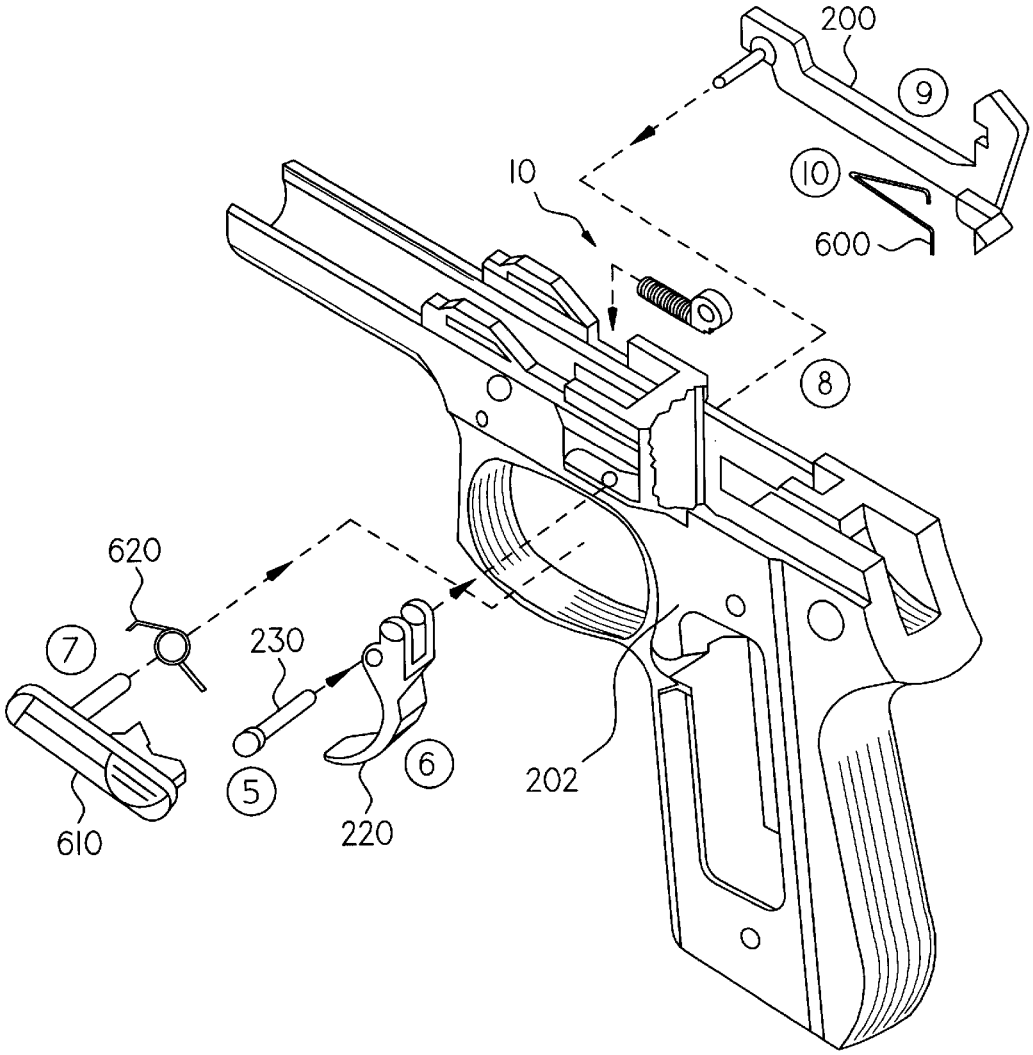
FIG. 7 illustrates some additional steps taken to replace a prior art trigger spring with the interchangeable, replacement gun trigger return system of the present invention.

After the factory spring 400 has been removed, the trigger pivot pin 230, taken out during removal of the factory spring, is reinserted, through the frame 202 and trigger 220 from which it came. This reinsertion of the trigger pivot pin 230 and trigger 220 is shown schematically in FIG. 7 as steps 5 and 6. Then, the slide lock spring 620 and slide lock 610 are reinstalled, as shown in FIG. 7 as step 7. The gun is then ready for the installation of the replacement trigger return system of the present invention.

The trigger return system 10 is placed down into the frame 202 as shown in FIG. 7, step 8, with the cam end of the system toward the rear of the gun. The trigger bar pin 200 is then inserted through one side of the frame, through the first side of the top trigger section 220*b*, through the cam 100, through the other side of the top trigger section 220*a*, and through the other side of the frame 202, as shown schematically in FIG. 7 as step 9. The trigger bar pin 200 is what holds the trigger return system 10 in place, in conjunction with the first end of the trigger return pin which is pushed against the frame under force of the trigger return spring. The trigger bar spring 600 must also be replaced after the trigger bar is reinstalled (FIG. 7, step 10). A suitable tool, such as a pen, knife blade, or finger, is then used to compress the spring of the trigger return system and push the front (first end) of the trigger return pin down into place as shown in FIG. 5. Finally, the grip covers, barrel, and slide are replaced and the conversion is complete.

It should be noted that the exact sequence of steps is not necessarily critical. For example, the trigger return system could be pushed down into place before or after the trigger bar spring is reinserted.

The present invention could also be used instead of, rather than as a replacement for, the original factory spring during OEM production. In such a situation, of course, the old spring does not have to be removed, and many of the above steps do not have to be executed. Rather, if the gun is being originally factory produced, the trigger return system 10 of the present invention is simply installed so as to fit in the gun as described above. In such a case, during the original insertion of the trigger bar, the system of the present invention is aligned so as to be retained by the trigger bar in accordance with the events described above. Thus, the steps followed during after-market replacement do not all apply. In the case of the original manufacturing, the system is simply inserted so as to perform as described herein.

Alternative embodiments could be developed by one skilled in the art which would be consistent with that described above. One such alternative, particularly as it pertains to an OEM installation of a spring system according to the present invention, would involve the use of a trigger return pin and spring very similar to that described above, but utilize a variant of the cam.

Variations of the invention can be contemplated. One variation would be where the trigger is not divided at its top as is the case with current triggers used in the Beretta® Model 92/96 series firearm and similar firearms. In such a case, the trigger pivot pin 230 still provides the axis of rotation for the trigger, as is the case with the configuration shown in FIG. 5 in which a receiver channel is defined as the space between walls 220*a* and 220*b* and between pins 200 and 230, as shown. In such a case, a receiver channel could be provided through the top section of the trigger in a direction perpendicular to the channel which receives trigger pin 230. This receiver channel receives trigger pin 130 as the trigger pivots around trigger pin 230 during operation. Important in this embodiment is the presence of adequate space within the receiving channel so as to provide room for movement of trigger return pin 130, during trigger rotation. In such a case as described, the cam is effectively made an integral part of the top of the trigger.

Although the present invention has been particularly described in conjunction with specific preferred embodiments, it is evident that many alternatives, modifications, and variations will be apparent to those skilled in the art. It is therefore contemplated that the appended claims will embrace any such alternatives, modifications, and variations as falling within the true scope and spirit of the present invention.

What is claimed is:

1. In a firearm having a frame, a trigger assembly cavity having a front generally vertical wall in said frame, a trigger bar mounted on said frame, a trigger pin mounted on said frame, and a trigger pivotally mounted on said trigger pin at the pivot axis of said trigger and adapted to move between an at rest position and a firing position, said trigger mounted on said trigger bar at a point above said pivot axis of said trigger, the improvement comprising:

a generally horizontally disposed trigger return pin positioned in said trigger assembly cavity, said trigger return pin having a first end and a second end wherein said first end of said trigger return pin is in contact with said generally vertical wall of said trigger assembly cavity;

a trigger return cam having a first cavity which is operatively connected to said trigger bar and a second cavity which is slidably connected to said second end of said trigger return pin; and a spring disposed coaxially around said trigger return pin and disposed between said first end of said trigger return pin and said trigger return cam for urging the trigger to the at rest position.

2. The firearm of claim 1, wherein said generally vertical wall has an indent to receive said first end of said trigger return pin.

3. The firearm of claim 1, wherein said second end of said trigger return pin has a cross sectional dimension greater than the diameter of said spring.

4. The firearm of claim 1 wherein said second end of said trigger return pin extends through said second cavity of said trigger return cam and is crimped whereby said trigger return cam cannot slide off said trigger return pin.

5. The firearm of claim 1 wherein said spring is compressed when said trigger return pin is slid through said second cavity.

6. The firearm of claim 1 wherein said spring is comprised of carbon steel.

7. The firearm of claim 6 wherein said carbon steel is ASTM A-228 carbon steel.

8. The firearm of claim 1 wherein said trigger return pin is coated with a lubricant.

9. The firearm of claim 1 wherein said trigger return pin is coated with a layer of electroless nickel and a layer of teflon PTFE finish.

10. The firearm of claim 1 wherein said trigger return pin is comprised of stainless steel.

11. A trigger return spring system for a firearm comprising:

a trigger return pin having a first end and a second end;

a trigger return cam having a first cavity adapted to receive a trigger bar and a second cavity adapted to receive said second end of said trigger return pin; and a spring disposed coaxially around said trigger return pin between said first end of said trigger return pin and said trigger return cam.

12. The trigger return spring system of claim 11 wherein said spring is compressed when said trigger return pin is slid through said second cavity.

13. The trigger return spring system of claim 11 wherein said spring is comprised of carbon steel.

14. The trigger return spring system of claim 13 wherein said carbon steel is ASTM A-228 carbon steel.

15. The trigger return spring system of claim 11 wherein said second end of said trigger return pin extends through said second cavity of said trigger return cam and is enlarged such that said trigger return cam cannot slide off said trigger return pin.

16. The trigger return spring system of claim 11 wherein said second end of said trigger return pin extends through said second cavity of said trigger return cam and is crimped whereby said trigger return cam cannot slide off said trigger return pin.

17. The trigger return spring system of claim 11 wherein said trigger return pin is coated with a lubricant.

18. The trigger return system of claim 11 wherein said trigger return pin is coated with a layer of electroless nickel and a layer of teflon PTFE finish.

19. The trigger return spring system of claim 11 wherein said trigger return pin is comprised of stainless steel.

20. A method of replacing a torsion trigger spring in a firearm having a frame, a slide, a barrel, a slide lock, a slide lock spring, a trigger assembly cavity having a front generally vertical wall in said frame, a trigger bar having a trigger bar pin mounted on said frame, a trigger bar spring disposed on said frame to urge said trigger bar to an at rest position, a trigger pin mounted on said frame, and a trigger pivotally mounted on said trigger pin at the pivot axis of said trigger, said trigger mounted on said trigger bar pin at a point above said pivot axis of said trigger, said method comprising the steps of:

forming a trigger return spring system from a spring, a cam, and a trigger return pin by:

coaxially inserting said trigger return pin in said spring;

sliding said cam onto said trigger return pin against said spring so that said trigger return pin extends beyond said cam on said side of said cam not contacting said spring; and crimping said trigger return pin on an end of said trigger return pin that extends beyond said cam whereby said spring and said cam are prevented from sliding off said trigger return pin;

removing said trigger bar and said trigger bar spring;

removing said slide lock;

removing said slide lock spring;

removing said trigger pin;

removing said torsion trigger spring;

reinserting said trigger pin;

reinserting said slide lock;

reinserting said slide lock spring;

inserting said previously formed trigger return spring system into said frame;

reinserting said trigger bar into said frame whereby said trigger bar pin is disposed through said previously formed cam; and reinserting said trigger bar spring.

21. The method of claim 20 further comprising the step of providing an indent in said generally vertical wall.

* * * * *